US011788364B2

(12) United States Patent
Al-Dhafeeri et al.

(10) Patent No.: US 11,788,364 B2
(45) Date of Patent: Oct. 17, 2023

(54) PORTABLE LOWER SHEAVE STAND FOR SLICKLINE UNIT

(71) Applicant: SAUDI ARABIAN OIL COMPANY, Dhahran (SA)

(72) Inventors: Abdullah M. Al-Dhafeeri, AlKhubar (SA); Abdulmohsen N. Al-Enezi, Khafji (SA); Sultan A. Al-Aklubi, Khafji (SA); Bader M. Al-Enezi, Khafji (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 31 days.

(21) Appl. No.: 17/346,896

(22) Filed: Jun. 14, 2021

(65) Prior Publication Data

US 2022/0397007 A1 Dec. 15, 2022

(51) Int. Cl.

| | |
|---|---|
| ***E21B 17/10*** | (2006.01) |
| ***E21B 19/22*** | (2006.01) |
| ***E21B 17/02*** | (2006.01) |
| ***E21B 19/08*** | (2006.01) |

(52) U.S. Cl.

CPC ..... *E21B 17/10* (2013.01); *E21B 17/026* (2013.01); *E21B 19/08* (2013.01); *E21B 19/22* (2013.01)

(58) Field of Classification Search

CPC ..... E21B 17/10; E21B 17/01; E21B 19/00; E21B 10/02; E21B 10/084; E21B 1/02; E21B 17/00; E21B 17/023; E21B 17/026; E21B 17/20; E21B 33/076

See application file for complete search history.

(56) References Cited

U.S. PATENT DOCUMENTS

| | | | | |
|---|---|---|---|---|
| 2017/0159375 | A1* | 6/2017 | Thomas | E21B 47/00 |
| 2018/0282137 | A1 | 10/2018 | Kaybidge | |
| 2019/0203575 | A1* | 7/2019 | Schlosser | E21B 23/08 |
| 2021/0309485 | A1* | 10/2021 | Claiborne | B60P 3/035 |

OTHER PUBLICATIONS

"Sheave Stand;" Jun. 10, 2021; p. 1; Retrieved from the Internet: URL: https://www.builtbyfhe.com/sheave_stand.html (1 page).

* cited by examiner

*Primary Examiner* — Yong-Suk (Philip) Ro

(74) *Attorney, Agent, or Firm* — Osha Bergman Watanabe & Burton LLP

(57) ABSTRACT

A system includes an upper sheave configured to orient a cable towards a well, a lower sheave, having a center, configured to orient the cable towards the upper sheave, and a sheave stand. The sheave stand includes a shaft, running through the center of the lower sheave, configured to enable rotation of the lower sheave about a central axis, a sheave holder, fixed to the shaft, configured to hold the lower sheave in a vertical position, a tool leg, fixed to the shaft, configured to elevate the shaft to a height above a surface, and a floor stand, fixed to the tool leg, configured to anchor the sheave stand to the surface. The sheave stand stabilizes the cable by maintaining the lower sheave in a fixed rotational position.

18 Claims, 5 Drawing Sheets

PORTABLE LOWER SHEAVE STAND FOR SLICKLINE UNIT

BACKGROUND

Hydrocarbon fluids are often found in hydrocarbon reservoirs located in porous rock formations below the earth's surface. Wells may be drilled to extract the hydrocarbon fluids from the hydrocarbon reservoirs. Wireline or slickline operations may occur on these wells while the well is being drilled, during production of the well, or at the end of the life of the well. Wireline/slickline operations utilize two sheaves, an upper sheave, and a lower sheave, to run wireline/slickline into or out of the well. The lower sheave is often chained to the wellhead during these operations. This loose fixation to the wellhead causes the lower sheave to move around erratically. This erratic movement causes the lower sheave to be unbalanced and prematurely wear or break the slickline/wireline.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in one or more embodiments, a system and a method of using the system to stabilize a cable during wellbore operations in a well. In general, and in one embodiment, the system includes an upper sheave configured to orient the cable towards the well, a lower sheave, having a center, configured to orient the cable towards the upper sheave, and a sheave stand. The sheave stand includes a shaft, running through the center of the lower sheave, configured to enable rotation of the lower sheave about a central axis, a sheave holder, fixed to the shaft, configured to hold the lower sheave in a vertical position, a tool leg, fixed to the shaft, configured to elevate the shaft to a height above a surface, and a floor stand, fixed to the tool leg, configured to anchor the sheave stand to the surface. The sheave stand stabilizes the cable by maintaining the lower sheave in a fixed rotational position.

In some embodiments, the method for using the system includes installing a lower sheave, having a center, in a sheave stand. The sheave stand includes a shaft, running through the center of the lower sheave, configured to enable rotation of the lower sheave about a central axis, a sheave holder, fixed to the shaft, configured to hold the lower sheave in a vertical position a tool leg, fixed to the shaft, configured to elevate the shaft to a height above a surface, and a floor stand, fixed to the tool leg, configured to anchor the sheave stand to the surface. The method continues with running the cable through an upper sheave configured to orient the cable towards the well, running the cable through the lower sheave configured to orient the cable towards the upper sheave, and stabilizing the cable by maintaining the lower sheave in a fixed rotational position using the sheave stand.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
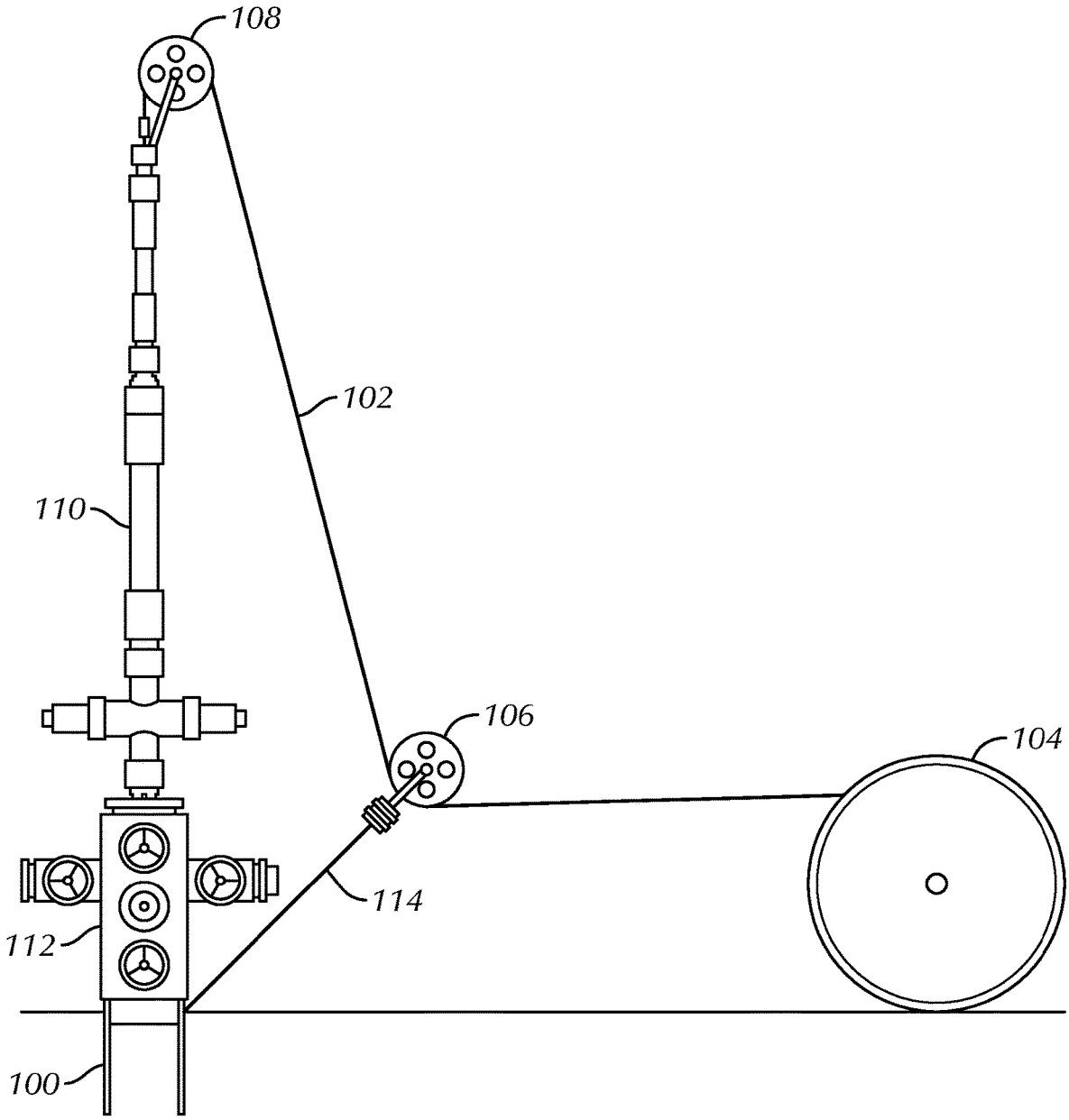
FIG. 1 depicts an exemplary slickline operation in accordance with one or more embodiments.

FIG. 1 depicts an exemplary slickline operation in accordance with one or more embodiments. A well (100) is a hole drilled into the Earth's surface that may be used to extract hydrocarbons from hydrocarbon formations. The slickline operation consists of running slickline (102) into a well (100) to perform various wellbore operations such as jarring or fishing operations. More specifically, a slickline operation utilizes a drum (104) to deploy or retract slickline (102) into or out of the well (100).

The drum (104) is a conveyance device with a length of slickline (102) wrapped around a central axis. The drum (104) may be freestanding, or the drum (104) may be attached to an object such as a truck. The drum (104) may have electronic controls that control the deployment and retraction of the slickline (102). The slickline (102) is a cable having no electrical or information transmission capabilities. The slickline (102) is directed into the well (100) through two sheaves: a lower sheave (106) and an upper sheave (108).

Sheaves are devices well known in the art, and they are used to hold/redirect cables and lift loads. As depicted in FIG. 1 the lower sheave (106) and the upper sheave (108) hold and redirect the slickline (102) towards the well (100). Further, the lower sheave (106) and the upper sheave (108) spin on axles which allows the slickline (102) to move freely. Prior to the slickline (102) entering the well (100), the slickline (102) passes through a lubricator (110) and a wellhead (112).

The lubricator (110) is made of high-pressure pipe and an assortment of valves. The lubricator (110) controls the difference in pressure between the pressurized well (100) and the atmosphere. The wellhead (112) is the surface termination of the well (100). It is a system of spools, valves, and assorted adapters that provide pressure control of the well (100). The lower sheave (106) may be attached to the well (100) though a chain (114).

The chain (114) allows the lower sheave (106) to move freely in all directions. The upper sheave (108) may be fixed to the lubricator (110) by a pipe or pipes welded, or otherwise connected, to both the lubricator (110) and the upper sheave (108). The upper sheave (108) may be held up by a crane or any other means known in the art. The operation depicted in FIG. 1 may become a wireline operation when the slickline (102) is wireline. Wireline is a cable that is electrically conductive and can transmit information.

When the lower sheave (106) is able to move freely by being attached to the wellhead (112) through a chain (114), the slickline (102) is not stable. When the slickline (102) is not stable, wellbore operations that cause a lot of movement in the slickline (102) may wear or break the slickline (102) prematurely. Thus, a device and system that can help stabilize the slickline (102) is beneficial. Further, such a device may allow for wellbore operations that require more tension and movement to occur. Herein, systems and methods for stabilizing slickline (102) or wireline are disclosed.

Figure 2A:
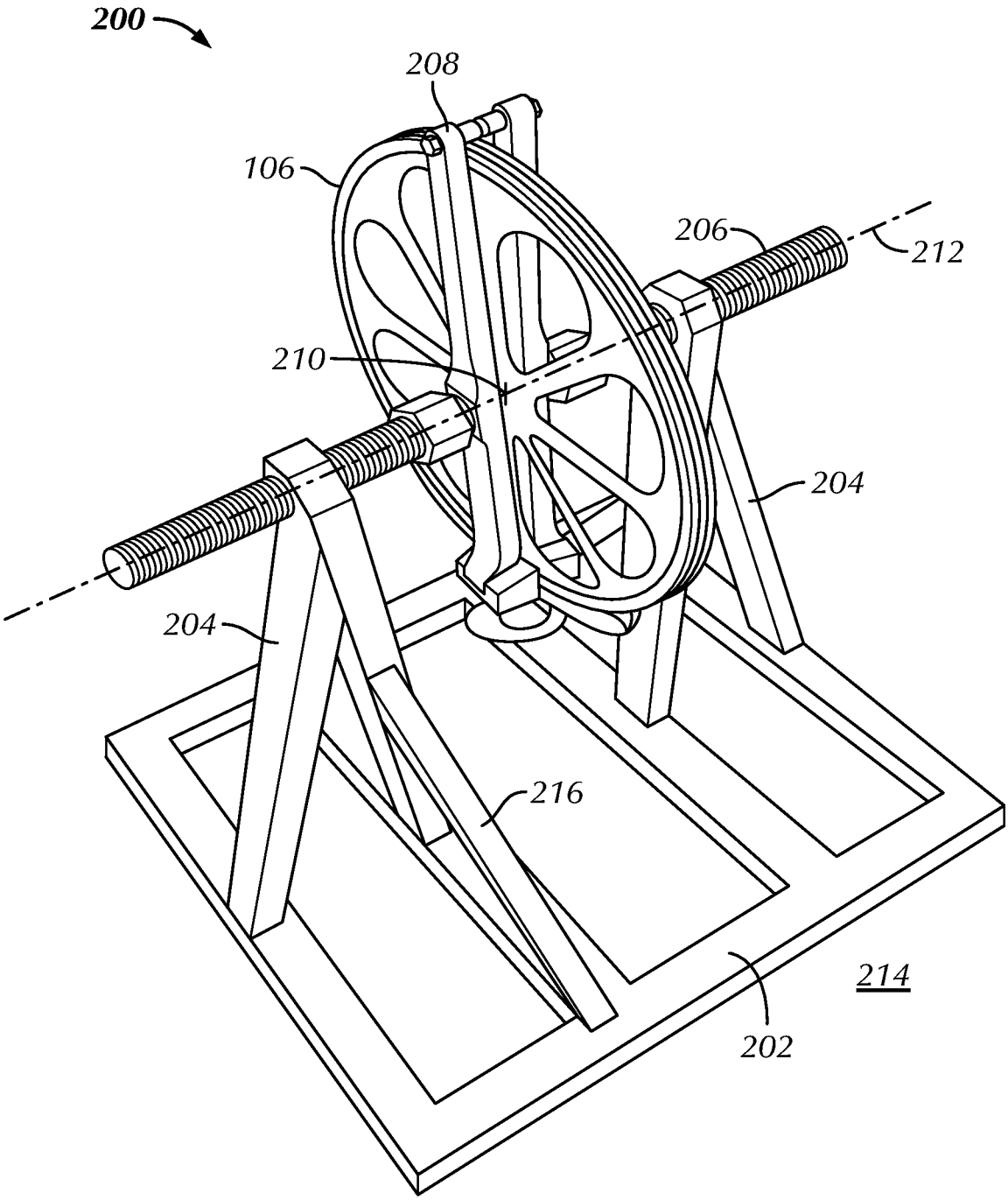
FIGS. 2*a* and 2*b* depict an apparatus in accordance with one or more embodiments.
Figure 2B:
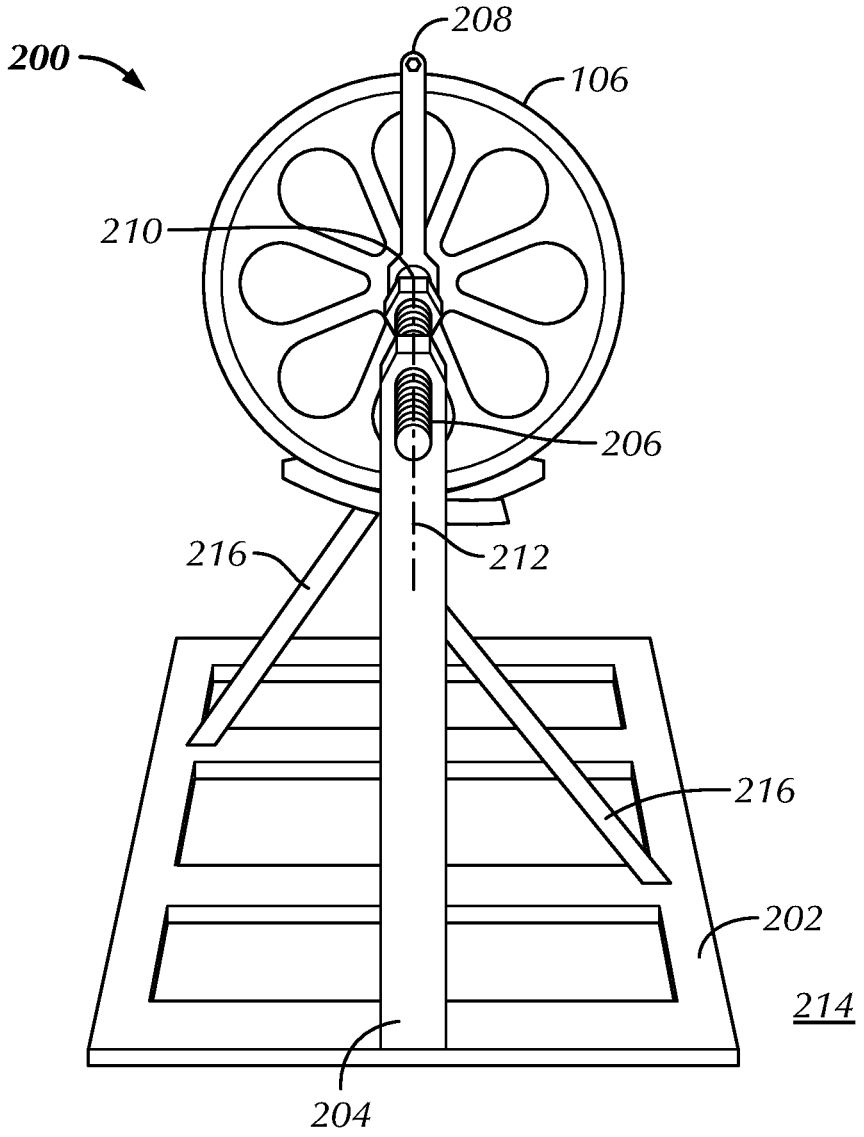

FIGS. 2*a* and 2*b* depict a sheave stand (200) in accordance with one or more embodiments. The sheave stand (200) has a floor stand (202), a plurality of tool legs (204), a shaft (206), a sheave, and a sheave holder (208). The sheave may be a lower sheave (106) as described in FIG. 1. The lower sheave (106) has a center (210) located at the geometric center of the lower sheave (106). The center (210) may have an orifice through which the shaft (206) may run through.

The shaft (206) enters and exits the center (210) of the lower sheave (106) as depicted in FIG. 2*a*. The shaft (206) enables rotation of the lower sheave (106) about a central axis (212). The shaft (206) may be in a fixed position such that only the lower sheave (106) rotates about the central axis (212). In other embodiments, the shaft (206) and the lower sheave (106) may rotate together about the central axis (212) if the shaft (206) is welded to, or otherwise fixed to, the center (210) of the lower sheave (106).

The sheave holder (208) is fixed to the shaft (206) to hold the lower sheave (106) in a fixed vertical position. The sheave holder (208) keeps the lower sheave (106) in a fixed rotational position such that the lower sheave (106) rotates about the central axis (212) while staying in the same vertical position. The sheave holder (208) may be fixed to the shaft (206) by any means known in the art such as being welded to the shaft (206) or being bolted into the shaft (206), as depicted in FIGS. 2*a* and 2*b*.

The shaft (206) may hold the sheave holder (208) in a fixed position. The sheave stand (200) depicted in FIGS. 2*a* and 2*b* depicts the shaft (206) and the sheave holder (208) in a fixed position while the lower sheave (106) rotates about the central axis (212); however, in other embodiments, the shaft (206), the sheave holder (208), and the lower sheave (106) may all rotate about the central axis (212). Rotation may be enabled by having a cable, such as the slickline (102), move through the lower sheave (106).

The shaft (206) may be fixed to a tool leg (204) or a plurality of tool legs (204) to elevate the shaft (206) to a height above a surface (214). The surface (214) may be any location that may hold the sheave stand (200) such as the Earth's surface, a floor, a table, a rig floor, etc. FIGS. 2*a* and 2*b* depict the shaft (206) fixed to two tool legs (204) each tool leg (204) shaped in an upside-down V-shape. Each tool leg (204) is fixed to either lateral end of the shaft (206). The tool legs (204) may be fixed to the shaft (206) by any means known in the art such as welding or by being bolted together.

The tool legs (204) hold the shaft (206) in a fixed position. In other embodiments, the shaft (206) may run through an orifice in the tool leg (204) such that the shaft (206) may rotate freely about the central axis (212). The tool legs (204) may be fixed to the floor stand (202) and the floor stand (202) anchors the sheave stand (200) to the surface (214). The floor stand (202) and the tool legs (204) may be fixed together by any means known in the art such as welding.

The tool leg (204) may have at least one support bar (216) fixed to the tool leg (204) and to the floor stand (202) to add further support to the sheave stand (200). The support bar (216) may be fixed to the floor stand (202) and the tool leg (204) by any means known in the art such as welding. The floor stand (202) may be made up of a plurality of beams as depicted in FIGS. 2*a* and 2*b*, or the floor stand (202) may be made of a solid sheet of material.

All of the components of the sheave stand (200) may be made of any material known in the art that is strong enough to handle the movements of the lower sheave (106) such as steel. In further embodiments, the sheave stand (200) may have at least one fastener that is fixes the floor stand (202) to the surface (214). The fastener may be any fastener known in the art such as a tie down cable, a bolt, a hook, etc.

In one or more embodiments, the sheave stand (200) may be made out of 3 mm thick stainless steel and weigh 14 kg. The floor stand (202) may be a square with a width and length of 70 cm. The height of the shaft (206), above the floor stand (202), is 64 cm. Each hypotenuse of the V of each tool leg (204) is 68 cm long, and the length of the sheave holder (208)/the outer diameter of the lower sheave (106) is 41 cm.

Figure 3:
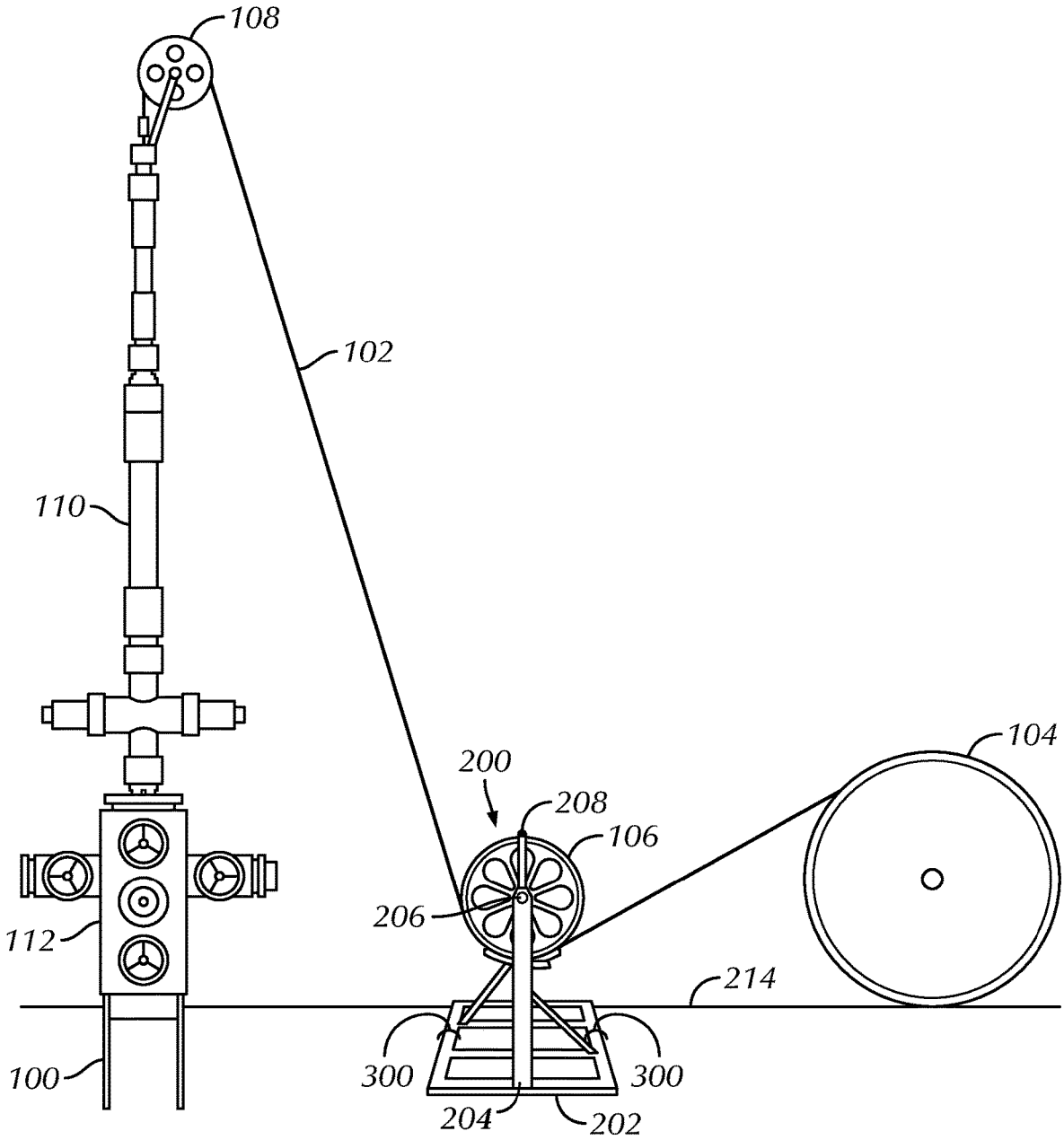
FIG. 3 depicts a system in accordance with one or more embodiments.

FIG. 3 depicts the sheave stand (200), depicted in FIGS. 2*a* and 2*b*, as a component of the slickline operation depicted in FIG. 1. The components of the system depicted in FIG. 3 that are identical/similar to the components described in FIGS. 1 and 2 are not re-described for purposes of readability and have the same functions described above. In other embodiments, the slickline operation may be a wireline operation without departing from the scope of this disclosure herein.

FIG. 3 shows the lower sheave (106) installed within the sheave stand (200) for a slickline operation. The lower sheave (106) may be installed within the sheave stand (200) prior to the slickline (102) being run through the lower sheave (106). The sheave stand (200) is located on the surface (214) of the Earth. The sheave stand (200) is fixed to the surface (214) using two fasteners (300) connected to the floor stand (202). The slickline (102) is run from the drum (104) and through the lower sheave (106) directed in a way such that the slickline (102) is directed towards the upper sheave (108).

The slickline (102) is run through the upper sheave (108) directed in a way such that the slickline (102) is directed towards the lubricator (110). The slickline (102) is run through the lubricator (110) and wellhead (112) prior to entering the well (100). The upper sheave (108) is maintained in a fixed rotational position by being mounted to the lubricator (110). The slickline (102) may have wellbore tools, such as a fishing jar, installed on the end of the slickline (102) after the slickline (102) has been run through the lower sheave (106) and upper sheave (108).

The shaft (206) of the sheave stand (200) is in a fixed position by being bolted to the tool legs (204), thus having the sheave holder (208), bolted to the shaft (206), in a fixed position. The sheave holder (208) holds the lower sheave (106) in a fixed vertical position to stabilize the slickline (102). The fasteners (300) further stabilize the slickline (102) by fixing the sheave stand (200) to the surface (214). The sheave stand (200) and corresponding stability prevents the slickline (102) from twisting and breaking during slickline operations.

Figure 4:
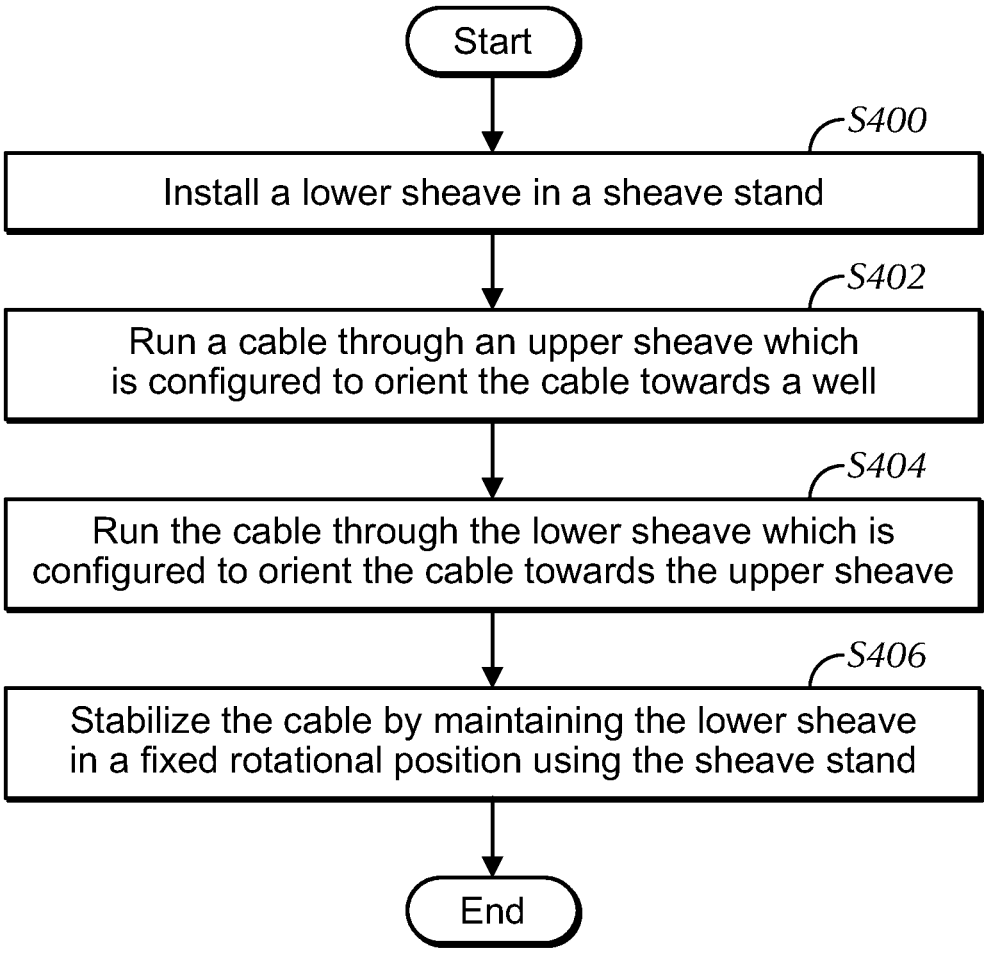
FIG. 4 depicts a flowchart in accordance with one or more embodiments.

FIG. 4 depicts a flowchart in accordance with one or more embodiments. More specifically, FIG. 4 illustrates a method for stabilizing a cable using a sheave stand (200). Further, one or more blocks in FIG. 4 may be performed by one or more components as described in FIGS. 1-3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a lower sheave (106) is installed in a sheave stand (200) (S400). The sheave stand (200) has a shaft (206), a sheave holder (208), at least one tool leg (204), and a floor stand (202). The lower sheave (106) is installed in the sheave stand (200) by running the shaft (206) through the center (210) of the lower sheave (106) and fixing the sheave holder (208) around the lower sheave (106). The shaft (206) is fixed in place by being bolted to the tool legs (204). The sheave holder (208) is also fixed in place by being bolted to the shaft (206).

The lower sheave (106) is able to rotate about the central axis (212) while being maintained in a vertical position. The tool legs (204) are connected to the floor stand (202) by being welded to the floor stand (202). A cable, such as slickline (102) or wireline, is wrapped around a conveyance device, such as a drum (104). A free end of the cable is run through an upper sheave (108) which is configured to orient the cable towards a well (100) (S402) having a wellhead (112) with a lubricator (110) installed on top of the wellhead (112).

The upper sheave (108) is maintained in a fixed rotational position by connecting the upper sheave (108) to the lubricator (110) using a mechanism such as two steel bars and a sheave holder (208). The cable is run through the lower sheave (106) which is configured to orient the cable towards the upper sheave (108) (S404). The conveyance device may deploy or retract the cable through the lower sheave (106), upper sheave (108), lubricator (110), wellhead (112), and well (100). The cable is stabilized by maintaining the lower sheave (106) in a fixed rotational position using the sheave stand (200) (S406).

In one or more embodiments, a jarring operation occurs on the well (100). The cable may be a slickline (102) and the slickline (102) is run, from the drum (104), through the lower sheave (106) and through the upper sheave (108). The free end of the slickline (102) may be connected to downhole/wellbore equipment including slickline jars. The downhole equipment may be run through the lubricator (110) and pressure may be equalized between the downhole equipment and the well (100).

The downhole equipment and the slickline (102) may be deployed through the wellhead (112) and the well (100) until they reach a target in the well (100). The slickline jars may jar up and down in the well (100). During the jarring operation, the sheave stand (200) stabilizes the lower sheave (106). This allows for more tension to be applied along the slickline (102) and reduces the chances of the slickline (102) tangling and breaking.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system for stabilizing a cable during wellbore operations in a well, the system comprising:
- a lubricator installed on top of a wellhead of the well;
- an upper sheave configured to redirect the cable towards the lubricator;
- a drum wrapped with the cable and comprising electronic controls configured to deploy and retract the cable;
- a lower sheave, having a center, configured to redirect the cable from the drum towards the upper sheave; and
- a sheave stand comprising:
  - a shaft, running through the center of the lower sheave, configured to enable rotation of the lower sheave about a central axis;
  - a sheave holder, fixed to the shaft, configured to hold the lower sheave in a vertical position;
  - a tool leg, fixed to the shaft, configured to elevate the shaft to a height above a surface; and
  - a floor stand, fixed to the tool leg, configured to anchor the sheave stand to the surface,
- wherein the sheave stand stabilizes the cable by maintaining the lower sheave in a fixed rotational position.

2. The system of claim 1, wherein the lubricator maintains the upper sheave in a fixed rotational position.

3. The system of claim 1, further comprising:
- at least one fastener configured to fix the floor stand to the surface.

4. The system of claim 1,
- wherein the tool leg is V-shaped.

5. The system of claim 1,
- wherein the cable is a wireline configured to transmit electricity and information.

6. The system of claim 1,
- wherein the cable is a slickline having no electrical or information transmission capabilities.

7. The system of claim 1,
- wherein the tool leg comprises at least one support bar.

8. The system of claim 1,
- wherein the tool leg holds the shaft in a fixed position.

9. The system of claim 8,
- wherein the shaft holds the sheave holder in a fixed position.

10. A method for stabilizing a cable during wellbore operations in a well, the method comprising:
- installing a lubricator on top of a wellhead of the well;
- wrapping the cable around a drum comprising electronic controls that deploy and retract the cable;
- installing a lower sheave, having a center, in a sheave stand wherein the sheave stand comprises:
  - a shaft, running through the center of the lower sheave, configured to enable rotation of the lower sheave about a central axis;

a sheave holder, fixed to the shaft, configured to hold the lower sheave in a vertical position;

a tool leg, fixed to the shaft, configured to elevate the shaft to a height above a surface; and a floor stand, fixed to the tool leg, configured to anchor the sheave stand to the surface;

running the cable through an upper sheave configured to redirect the cable towards the lubricator;

running the cable through the lower sheave configured to redirect the cable from the drum towards the upper sheave; and stabilizing the cable by maintaining the lower sheave in a fixed rotational position using the sheave stand.

11. The method of claim 10, further comprising:

maintaining the upper sheave in a fixed rotational position using the lubricator.

12. The method of claim 10, further comprising:

fixing the floor stand to the surface using at least one fastener.

13. The method of claim 10, wherein the tool leg is V-shaped.

14. The method of claim 10, wherein the cable is a wireline configured to transmit electricity and information.

15. The method of claim 10, wherein the cable is a slickline having no electrical or information transmission capabilities.

16. The method of claim 10, wherein the tool leg comprises at least one support bar.

17. The method of claim 10, wherein the tool leg holds the shaft in a fixed position.

18. The method of claim 17, wherein the shaft holds the sheave holder in a fixed position.

* * * * *